US010022764B2

(12) United States Patent
Nishimura et al.

(10) Patent No.: US 10,022,764 B2
(45) Date of Patent: Jul. 17, 2018

(54) MANUFACTURING METHOD OF PRESS-FORMED MEMBER AND PRESS FORMING APPARATUS

(71) Applicant: NIPPON STEEL & SUMITOMO METAL CORPORATION, Tokyo (JP)

(72) Inventors: Ryuichi Nishimura, Tokyo (JP); Yoshiaki Nakazawa, Tokyo (JP); Kenichiro Otsuka, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 296 days.

(21) Appl. No.: 14/765,762

(22) PCT Filed: Mar. 20, 2014

(86) PCT No.: PCT/JP2014/057846
§ 371 (c)(1),
(2) Date: Aug. 4, 2015

(87) PCT Pub. No.: WO2014/148618
PCT Pub. Date: Sep. 25, 2014

(65) Prior Publication Data

US 2015/0367392 A1 Dec. 24, 2015

(30) Foreign Application Priority Data

Mar. 21, 2013 (JP) ..... 2013-059047

(51) Int. Cl.
*B21D 5/02* (2006.01)
*B21D 22/20* (2006.01)
(Continued)

(52) U.S. Cl.
CPC ..... *B21D 5/0209* (2013.01); *B21D 5/01* (2013.01); *B21D 19/08* (2013.01); *B21D 22/20* (2013.01); *B21D 53/88* (2013.01)

(58) Field of Classification Search
CPC ..... B21D 5/0209; B21D 5/01; B21D 22/20; B21D 22/206; B21D 22/22; B21D 22/24;
(Continued)

(56) References Cited

U.S. PATENT DOCUMENTS 4,398,984 A 8/1983 Uchiyama et al.
5,921,618 A * 7/1999 Mori ..... B62D 21/157 296/187.12
(Continued)

FOREIGN PATENT DOCUMENTS

FR 2889466 A1 * 2/2007 ..... B21D 22/208
JP 5-023761 A 2/1993
(Continued)

OTHER PUBLICATIONS

EPO translation of FR 2889466 A1.*
(Continued)

*Primary Examiner* — R. K. Arundale
*Assistant Examiner* — Pradeep C Battula
(74) *Attorney, Agent, or Firm* — Birch, Stewart, Kolasch & Birch, LLP

(57) ABSTRACT

In a press forming step of obtaining, from a blank of high-tensile strength steel sheet of 390 MPa or more, a press-formed product with a shape of cross section having a groove bottom part, ridge line parts, and vertical wall parts. An outward flange including parts along the ridge line parts is formed at an end part in a longitudinal direction. Forming parts to the ridge line parts is started by creating a region positioned at an end portion, in a longitudinal direction, of a part to be formed to the groove bottom part of the blank, which is separated from a punch top part. At that time or thereafter, the region is made to approach the punch top part. When forming the ridge line parts, forming of the parts of the outward flange are conducted, the parts are formed from
(Continued)

the start to the middle of the press forming, to reduce or prevent an occurrence of stretch flange fracture and a generation of wrinkling

8 Claims, 11 Drawing Sheets

(51) Int. Cl.
*B21D 5/01* (2006.01)
*B21D 19/08* (2006.01)
*B21D 53/88* (2006.01)

(58) Field of Classification Search
CPC ..... B21D 22/26; B21D 22/28; B21D 22/30; B21D 19/02; B21D 19/08; B21D 19/10
See application file for complete search history.

(56) References Cited

U.S. PATENT DOCUMENTS

| | | | | |
|---|---|---|---|---|
| 6,604,781 | B2 * | 8/2003 | Uchida | B62D 25/20 296/203.01 |
| 7,310,878 | B2 * | 12/2007 | Chernoff | B62D 25/20 29/421.1 |
| 7,971,466 | B2 * | 7/2011 | Yoshitome | B21D 22/02 72/355.2 |
| 8,402,804 | B2 * | 3/2013 | Nakao | B21D 22/06 72/347 |
| 8,511,129 | B2 * | 8/2013 | Tamai | B21D 22/22 72/347 |
| 2005/0193795 | A1 | 9/2005 | Nieschulz et al. | |
| 2014/0144560 | A1 | 5/2014 | Yamano et al. | |
| 2014/0356643 | A1 * | 12/2014 | Nakata | B21D 22/26 428/603 |

FOREIGN PATENT DOCUMENTS

| | | | |
|---|---|---|---|
| JP | 2006-305627 | A | 11/2006 |
| JP | 2007-029966 | A | 2/2007 |
| JP | 2007-326112 | A | 12/2007 |
| JP | 2009-255116 | A | 11/2009 |
| JP | 4438468 | B2 | 3/2010 |
| JP | 2010-082660 | A | 4/2010 |
| JP | 2012-051005 | A | 3/2012 |
| WO | WO 2013/012006 | A1 | 1/2013 |

OTHER PUBLICATIONS

ArcelorMittal Automotive Worldwide; http://automotive.arcelormittal.com/europe/products/UHSS/Usibor/EN; USIBOR 1500 properties.*

English translation of the International Preliminary Report on Patentability and Written Opinion of the International Searching Authority (Forms PCT/IB/338, PCT/IB/373 and PCT/ISA/237), dated Oct. 1, 2015, for International, Application No. PCT/JP2014/057846.

Canadian Office Action dated Jul. 26, 2016, issued in corresponding Canadian Patent Application No. 2,901,744.

International Search Report issued in PCT/JP2014/057846, dated May 13, 2014.

Written Opinion issued in PCT/JP2014/057846, dated May 13, 2014.

Extended European Search Report dated Oct. 10, 2016, for European Application No. 14768860.0.

* cited by examiner

MANUFACTURING METHOD OF PRESS-FORMED MEMBER AND PRESS FORMING APPARATUS

TECHNICAL FIELD

The present invention relates to a manufacturing method of a press-formed member and a press forming apparatus, for manufacturing a press-formed member, from a blank of high-tensile strength steel sheet of 390 MPa or more, with a shape of cross section having at least a groove bottom part, a ridge line part continued to an end portion in a width direction of the groove bottom part, and a vertical wall part continued to the ridge line part, and in which an outward flange including a part along the ridge line part is formed at an end part in a longitudinal direction.

BACKGROUND ART

A floor of an automobile vehicle body (hereinafter, simply referred to as "floor") is not only primary responsible for torsional rigidity and bending rigidity of a vehicle body when the vehicle travels, but also responsible for transfer of an impact load when a crash occurs, and further, it exerts a large influence on a weight of the automobile vehicle body, so that it is required to have antinomy characteristics such as high rigidity and light weight. The floor includes planar panels (for example, a dash panel, a front floor panel, a rear floor panel, and so on) which are welded to be jointed with each other, long cross members (for example, a floor cross member, a seat cross member, and so on) having approximately hat-shaped cross sections which are fixed to be disposed in a vehicle width direction of these planar panels by welding to enhance rigidity and strength of the floor, and long members (a side sill, a side member, and so on) having approximately hat-shaped cross sections which are fixed to be disposed in a forward and rearward direction of vehicle body to enhance the rigidity and the strength of the floor. Out of the above, the cross members are normally jointed to other members such as, for example, a tunnel part of the front floor panel and the side sill by using outward flanges formed at both end parts in a longitudinal direction thereof as joint margins.

FIG. 8A to FIG. 8C are explanatory views illustrating a floor cross member 1 being a typical example of the cross members, in which FIG. 8A is a perspective view of the floor cross member 1, FIG. 8B is a VIII arrow view in FIG. 8A, and FIG. 8C is an explanatory view illustrating a portion surrounded by a circular dotted line in FIG. 8B, in an enlarged manner.

For example, a front floor panel 2 generally includes a tunnel part (illustration is omitted) jointed to an upper surface (a surface at an interior side) of the front floor panel 2 and placed at approximately a center in a width direction of the front floor panel 2, and side sills 3 spot-welded at both side parts in the width direction of the front floor panel 2. The floor cross member 1 is jointed to the tunnel part and the side sills 3 by the spot welding or the like using outward flanges 4 formed at both end parts in a longitudinal direction thereof as joint margins, thereby improving rigidity of the floor and a load transfer characteristic when an impact load is applied.

FIG. 9A and FIG. 9B are explanatory views illustrating an outline of a conventional press forming method of the floor cross member 1, in which a region of an end part in a longitudinal direction of the member 1, in particular, is illustrated in an enlarged manner. FIG. 9A illustrates a case where the press forming is performed by drawing, and FIG. 9B illustrates a case where the press forming is performed by bend forming using an expanded blank 6.

The floor cross member 1 has been formed so far in a manner that an excessive material volume part 5*a* is formed at a forming material 5 through the press forming by the drawing as illustrated in FIG. 9A, the excessive material volume part 5*a* is cut along a cutting-line 5*b*, and a flange 5*c* is then raised, or the press forming by the bend forming is performed on the expanded blank 6 having an expanded blank shape as illustrated in FIG. 9B. Note that from a point of view of the improvement of material yield, the press forming by the bend forming is more preferable than the press forming by the drawing accompanied by the cutting of the excessive material volume part 5*a*.

The floor cross member 1 is an important structural member which is responsible for the rigidity improvement of the automobile vehicle body and transfer of the impact load at a time of side surface crash (side impact). Accordingly, in recent years, a thinner and higher-tensile strength steel sheet, for example, a high-tensile strength steel sheet with a tensile strength of 390 MPa or more (a high tensile strength steel sheet or a high-ten) has been used as a material of the floor cross member 1, from a point of view of reduction in weight and improvement in crash safety. However, formability of the high-tensile strength steel sheet is not good, and therefore, it is a problem that flexibility of design of the floor cross member 1 is low.

This will be concretely described with reference to FIG. 8A to FIG. 8C.

It is desirable that the outward flange 4 at the end part in the longitudinal direction of the floor cross member 1 is continuously formed by including a part 4*a* along a ridge line part 1*a*, and has a certain degree of flange width, as indicated by a dotted line in FIG. 8C, in order to enhance jointing strength between the floor cross member 1 and the tunnel part of the front floor panel 2, the side sills 3, and to enhance the rigidity of the floor and the load transfer characteristic when the impact load is applied.

However, when the continuous outward flange 4 including the part 4*a* along the ridge line part 1*a* is tried to be formed through cold press forming, and the certain degree of flange width is tried to be obtained, basically, stretch flange fractures at an outer peripheral edge portion of the part 4*a* along the ridge line part 1*a*, and wrinkling at an end portion 1*b* in a longitudinal direction of the ridge line part 1*a* of the floor cross member 1 and at a position from a center portion to a vicinity of a root of the part 4*a* along the ridge line part 1*a* occur, which makes it difficult to obtain a desired shape. These forming failures are easy to occur as a strength of steel material used for the floor cross member 1 is higher, and in a shape with higher stretch flange rate at the forming of the part 4*a* along the ridge line part 1*a* (namely, for example, as a cross sectional wall angle $\theta$ in FIG. 8B or a rising angle $\alpha$ of an end part (refer to FIG. 1B) is steeper).

The floor cross member 1 tends to be high-strengthened to reduce the weight of the automobile vehicle body, so that the cold forming of the continuous outward flange 4 including the part 4*a* along the ridge line part 1*a* tends to be difficult to be enabled by the conventional press forming method. Accordingly, even if lowering of the rigidity in the vicinity of the joint part of the floor cross member 1 with the other member and the load transfer characteristic is accepted, due to restrictions on the press forming technology as stated above, it is the present situation in which the occurrence of forming failures has to be avoided by providing, to the parts 4*a* along the ridge line parts 1*a* of the outward flange 4 of the floor cross member 1 made of the high-tensile strength steel sheet, cutouts 4*b* each of which is deep to some extent that it reaches the end portion 1*b* in the longitudinal direction of the ridge line part 1*a*, as illustrated in FIG. 8A and FIG. 8B.

Patent Literatures 1 to 4 disclose the inventions in which the improvement in the shape freezing property after the forming is realized by devising a pad of a forming tool, in order to manufacture a press-formed member having a hat-shaped cross section. Further, Patent Literature 5 discloses the invention in which a movable punch of a forming tool is devised to perform press forming on a panel component.

CITATION LIST

Patent Literature

Patent Literature 1: Japanese Patent Publication No. 4438468

Patent Literature 2: Japanese Laid-open Patent Publication No. 2009-255116

Patent Literature 3: Japanese Laid-open Patent Publication No. 2012-051005

Patent Literature 4: Japanese Laid-open Patent Publication No. 2010-82660

Patent Literature 5: Japanese Laid-open Patent Publication No. 2007-326112

SUMMARY OF INVENTION

Technical Problem

However, any of Patent Literatures 1 to 5 is not intended for a press-formed member formed from a blank of high-tensile strength steel sheet of 390 MPa or more, with a shape of cross section having at least a groove bottom part, ridge line parts continued to end portions in a width direction of the groove bottom part, and vertical wall parts continued to the ridge line parts, and in which an outward flange including parts along the ridge line parts is formed at an end part in a longitudinal direction.

According to results of studies conducted by the present inventors, it was difficult, even based on the conventional inventions, to manufacture a press-formed member made of a high-tensile strength steel sheet of 390 MPa or more, desirably 590 MPa or more, and more desirably 980 MPa or more, with a shape of cross section having at least a groove bottom part, ridge line parts, and vertical wall parts, and in which an outward flange including parts along the ridge line parts is formed at an end part in a longitudinal direction, through press forming, without providing cutouts which are deep enough to reach the ridge line parts to the parts along the ridge line parts of the outward flange and without generating lowering of material yield.

The present invention was made in view of the points as described above, and an object thereof is to enable a manufacture of a press-formed member, such as a floor cross member, for example, made of a high-tensile strength steel sheet of 390 MPa or more, desirably 590 MPa or more, and more desirably 980 MPa or more, with a shape of cross section having at least a groove bottom part, ridge line parts, and vertical wall parts, and in which an outward flange including parts along the ridge line parts is formed at an end part in a longitudinal direction, through press forming, without providing cutouts which are deep enough to reach the ridge line parts to the parts along the ridge line parts of the outward flange and without generating lowering of material yield.

Solution to Problem

The present invention is as cited below.

(1) A manufacturing method of a press-formed member, comprising a press forming step of obtaining, from a blank of high-tensile strength steel sheet of 390 MPa or more, a press-formed product with a shape of cross section having at least a groove bottom part, a ridge line part continued to an end portion in a width direction of the groove bottom part, and a vertical wall part continued to the ridge line part, and in which an outward flange including a part along the ridge line part is formed at an end part in a longitudinal direction, by using a press forming apparatus including a punch and a die, wherein the press forming step includes:

a first step of starting forming of a part to be formed to the ridge line part and forming of the outward flange, by creating a state where a region positioned at least at an end portion in a longitudinal direction of a part to be formed to the groove bottom part of the blank is separated from a punch top part, in the punch, which forms the groove bottom part;

a second step of making, at the time of starting the forming of the part to be formed to the ridge line part or thereafter, the region approach the punch top part; and completing, when the press forming is completed, the forming of the groove bottom part, the forming of the ridge line part, the forming of the vertical wall part, and the forming of the outward flange.

(2) The manufacturing method of the press-formed member according to (1) is characterized in that in the first step, the region is set to be in the state of being separated from the punch top part by creating a state where a first pad provided to be able to freely protrude from or withdraw into the punch top part, is protruded from the punch top part, and in the second step, the first pad is lowered to make the region approach the punch top part.

(3) The manufacturing method of the press-formed member according to (2) is characterized in that the first pad and a second pad provided on a side opposite to that of the first pad with the blank provided therebetween are used to sandwich and bind the blank.

(4) The manufacturing method of the press-formed member according to any one of (1) to (3) is characterized in that it further includes a post-press forming step with respect to the press-formed product, in which in the post-press forming step, the outward flange of the press-formed product is further raised.

(5) A manufacturing method of a press-formed member, comprising a press forming step of obtaining, from a blank of high-tensile strength steel sheet of 390 MPa or more, a press-formed product with a shape of cross section having at least a groove bottom part, a ridge line part continued to an end portion in a width direction of the groove bottom part, and a vertical wall part continued to the ridge line part, and in which an outward flange including a part along the ridge line part is formed at an end part in a longitudinal direction, by using a press forming apparatus including a punch and a die, wherein the press forming step includes:

creating a state where a radius of curvature $r_p$ of each of the part to be formed to the ridge line part of the blank once becomes larger than a radius of curvature $r_f$ of each of the ridge line part at a point of time of completion of the press forming, in the middle of the press forming;

making the radius of curvature $r_p$ approach the radius of curvature $r_f$ in a process of the press forming thereafter; and completing, when the press forming is completed, the forming of the groove bottom part, the forming of the ridge line part, the forming of the vertical wall part, and the forming of the outward flange.

(6) The manufacturing method of the press-formed member according to (5) is characterized in that, in the state where the radius of curvature $r_p$ becomes larger than the radius of curvature $r_f$, a region in which the curvature is formed is in a state of being wider than a region of each of the ridge line part at the point of time of completion of the press forming, and is in a state of being widened by being extended toward the groove bottom part side.

(7) A press forming apparatus which manufactures a press-formed member, from a blank of high-tensile strength steel sheet of 390 MPa or more, with a shape of cross section having at least a groove bottom part, a ridge line part continued to an end portion in a width direction of the groove bottom part, and a vertical wall part continued to the ridge line part, and in which an outward flange including a part along the ridge line part is formed at an end part in a longitudinal direction, the press forming apparatus comprising:

a punch;

a die; and a first pad capable of freely protruding from or withdrawing into a punch top part, in the punch, which forms the groove bottom part, and abutting against one surface of the blank, wherein:

forming of a part to be formed to the ridge line part and forming of the outward flange are started by creating a state where a region positioned at least at an end portion in a longitudinal direction of a part to be formed to the groove bottom part of the blank is separated from the punch top part, in the punch, which forms the groove bottom part, by setting the first pad to be in a state of protruding from the punch top part;

the first pad is lowered at the time of starting the forming of the part to be formed to the ridge line part or thereafter, to make the region approach the punch top part; and when the press forming is completed, the forming of the groove bottom part, the forming of the ridge line part, the forming of the vertical wall part, and the forming of the outward flange are completed.

Advantageous Effects of Invention

According to the present invention, it becomes possible to manufacture a press-formed member made of a high-tensile strength steel sheet of 390 MPa or more, desirably 590 MPa or more, and more desirably 980 MPa or more, with a shape of cross section having at least a groove bottom part, a ridge line part, and a vertical wall part, and in which an outward flange including a part along the ridge line part is formed at an end part in a longitudinal direction, through press forming, without providing cutouts which are deep enough to reach the ridge line part to the part along the ridge line part of the outward flange and without generating lowering of material yield.

According to the press-formed member, since the member can be jointed to another member without cutting-out the end portion in the longitudinal direction of the ridge line parts, it is possible to enhance the rigidity in the vicinity of the joint part of the press-formed member with the other member, and the load transfer characteristic. Accordingly, if the press-formed member is used as a floor cross member, for example, the bending rigidity and the torsional rigidity of body shell can be increased, and it is possible to enhance driving stability and riding comfort and to improve noise of automobile.

DESCRIPTION OF EMBODIMENTS

Hereinafter, embodiments for carrying out the present invention will be described with reference to the attached drawings.

A manufacturing method of a press-formed member according to the present embodiment includes a press forming step of obtaining a press-formed product from an expanded blank (which will be simply referred to as "blank", hereinafter) of a steel sheet having a shape based on a product shape. Further, if a predetermined shape cannot be achieved only by the press step, the method further includes a post-press forming step of performing forming on the press-formed product to set the product to be a press-formed member as a product. Note that although it is set that the expanded blank is used, the present invention is not limited to this, and it is also possible to apply the present invention to a case where trimming in which a part of the outward flange is cut-off, is performed after the press forming step, for example.

Accordingly, a shape of the press-formed member as a product will be first described, and subsequently, the press forming step and the post-press forming step will be described in this order.

(1) Press-Formed Member

Figure 1A:
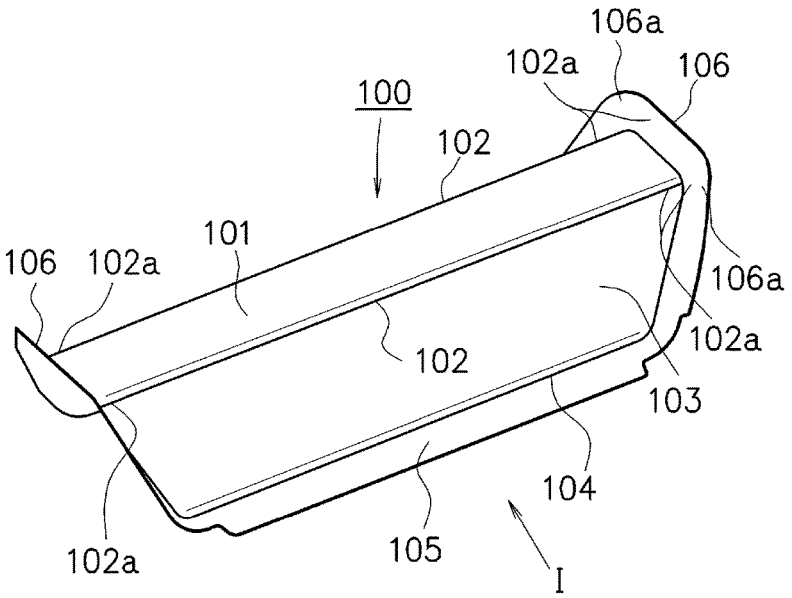
FIG. 1A is a perspective view of a press-formed member.
Figure 1B:
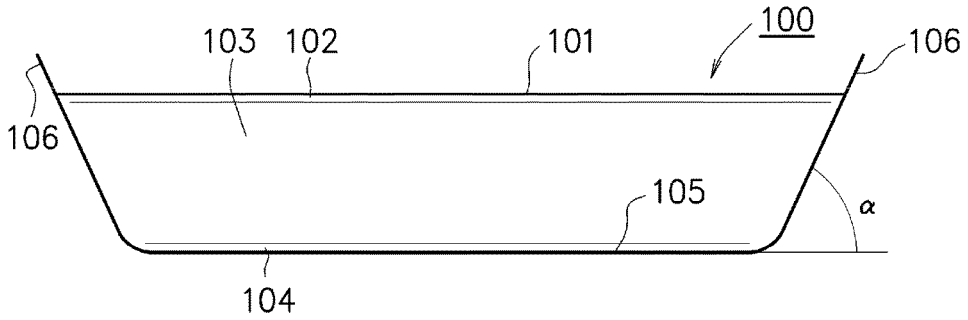
FIG. 1B is a I arrow view in FIG. 1A.
Figure 1C:
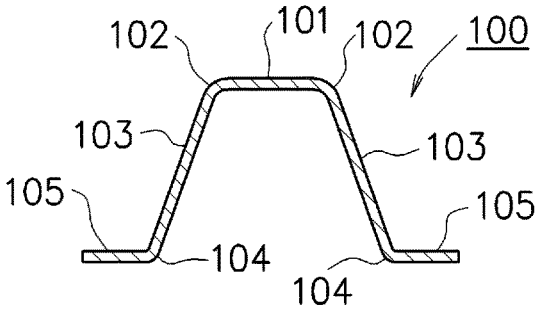
FIG. 1C is a sectional view at a middle position in a longitudinal direction of the press-formed member.

FIG. 1A to FIG. 1C are explanatory views illustrating one example of a press-formed member 100 targeted by the present invention, in which FIG. 1A is a perspective view of the press-formed member 100, FIG. 1B is a I arrow view in FIG. 1A, and FIG. 1C is a sectional view at a middle position in a longitudinal direction of the press-formed member 100 (illustration of an outward flange 106 is omitted).

The press-formed member 100 is obtained by performing press forming on a blank of high-tensile strength steel sheet of 390 MPa or more, and has a long length and approximately hat-shaped cross section. Specifically, the press-formed member 100 has a long groove bottom part 101, two ridge line parts 102, 102 continued to both end portions in a width direction of the groove bottom part 101, two vertical wall parts 103, 103 respectively continued to the two ridge line parts 102, 102, two curved parts 104, 104 respectively continued to the two vertical wall parts 103, 103, and two flanges 105, 105 respectively continued to the two curved parts 104, 104.

At an end part in the longitudinal direction of the press-formed member 100, an outward flange 106 including parts 106*a* along the ridge line parts 102 is formed. In this example, at both end parts in the longitudinal direction of the press-formed member 100, outward flanges 106 continued from the groove bottom part 101 along lower portions of the two vertical wall parts 103, 103 are formed, and the outward flanges 106 are continued also to the flanges 105.

As illustrated in FIG. 1B, a rising angle of the end part of the press-formed member 100 is a. A part, along the groove bottom part 101, of the outward flange 106 rises at an angle in accordance with a surface to be jointed, and when the part is connected to a flat surface of a surface to be jointed whose angle is the same as the rising angle of the end part of the press-formed member 100, for example, the rising angle of the part is a. Further, a part, along the vertical wall part 103, of the outward flange 106 rises at an angle in accordance with a surface to be jointed, and when the part is connected at right angle to a flat surface of the surface to be jointed, for example, the part rises approximately perpendicular to the vertical wall part 103.

Such a press-formed member 100 is particularly suitable for structural members of automobile (for example, cross members such as a floor cross member, and members such as a side sill and a side member). Further, in such an application, it is preferable to use, as a steel material, a high-tensile strength steel sheet such as a 980 MPa class dual phase steel sheet, for example, and by applying the present invention, it is possible to manufacture the press-formed member 100 even if the high-tensile strength steel sheet having a difficulty in forming is used.

In the present embodiment, explanation is given by setting a press-formed member having a long length and having an approximately hat-shaped cross section as above, as a typical example. However, a press-formed member targeted by the present invention is not limited to this, and the present invention can also be similarly applied to, for example, one having an approximately U-shaped cross section, one having a shape which is a part of an approximately hat shape (a shape of a half side of the approximately hat shape of the cross section, as an example), and one in which a length in a longitudinal direction of a groove bottom part is relatively short such that it is about the same as a width.

(2) Press Forming Step

Figure 2:
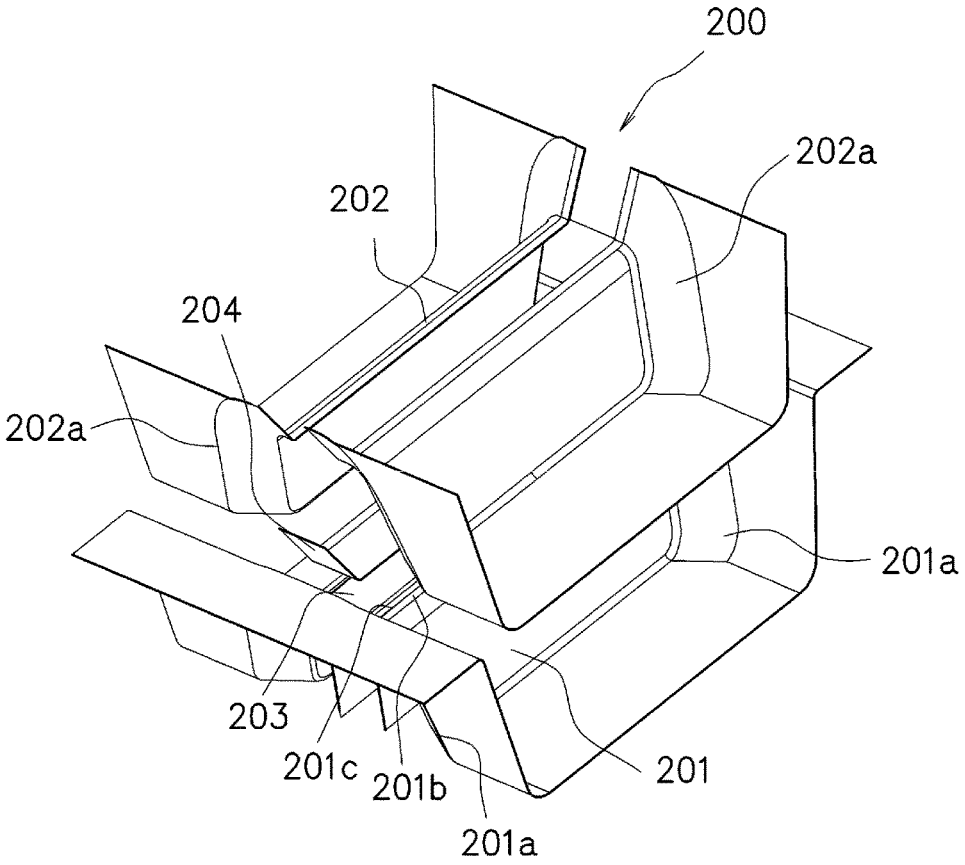
FIG. 2 is a view illustrating an example of a press forming tool of a press forming apparatus used in a press forming step.

FIG. 2 illustrates an example of a press forming tool of a press forming apparatus 200 used in the press forming step.

The press forming apparatus 200 includes a punch 201 and a die 202. On both ends of the punch 201 and the die 202, wall surfaces are provided, and on the wall surfaces, outward flange forming surfaces 201*a*, 202*a* for forming the outward flanges 106 are provided.

Further, the press forming apparatus 200 includes a first pad (inner pad) 203 which can freely protrude from or withdraw into a punch top part 201*b*, and which abuts against one surface of a blank 300 (not-illustrated in FIG. 2). The punch 201 is provided with a pad housing hole 201*c* having a size capable of completely housing the first pad 203. On a bottom of the pad housing hole 201*c*, a pressure device such as, for example, a gas cylinder or a coil spring is disposed, or the bottom of the pad housing hole 201*c* is connected to a cushion structure provided to a press machine, which enables to apply force to the first pad 203 in a direction of the blank 300.

Further, the press forming apparatus 200 includes a second pad 204 which abuts against the other surface of the blank 300 (not-illustrated in FIG. 2) and which can move in a moving direction of the die 202, and a pressure device (not-illustrated). Both end parts in a longitudinal direction of the second pad 204 rise to form outward flange forming surfaces together with the outward flange forming surfaces 202*a* of the die 202.

FIG. 3A to FIG. 3D are explanatory views schematically illustrating states of the press forming step.

Figure 3A:
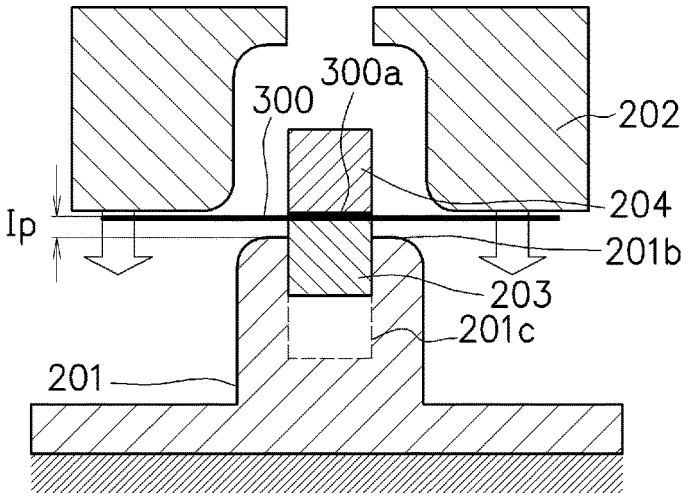
FIG. 3A is an explanatory view schematically illustrating a state of the press forming step, and a view illustrating a state before starting the press forming.
Figure 4A:
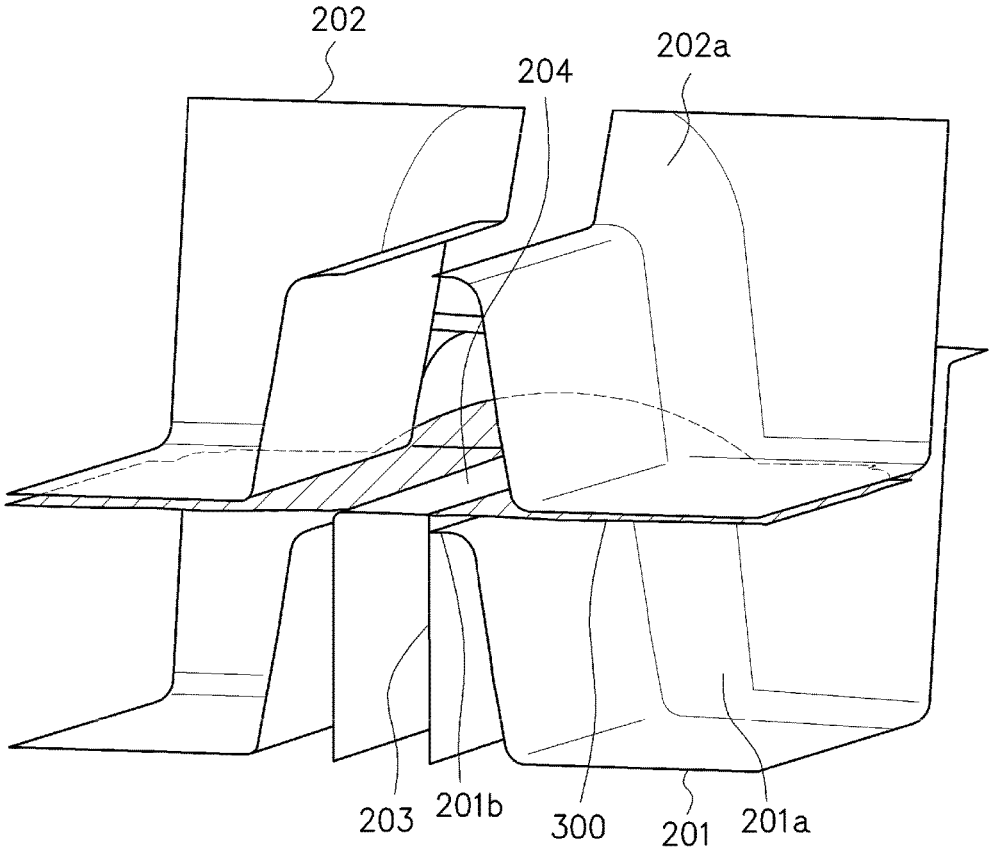
FIG. 4A is a view illustrating a state before starting the press forming through the press forming step.

FIG. 3A illustrates a state before starting the press forming. Further, FIG. 4A illustrates a state before starting the press forming, in a similar manner to FIG. 3A, and illustrates shapes of the respective parts and the like more concretely.

The first pad 203 is provided at a center in a width direction of the punch top part 201*b*, and at a position facing a region 300*a* being one part of a part to be formed to the groove bottom part 101 of the blank 300.

The first pad 203 is applied force in the direction of the blank 300 by the pressure device, and supports the region 300*a* of the blank 300 at a position at which it protrudes from the punch top part 201*b*. In a manner as described above, the first pad 203 separates one part of the part to be formed to the groove bottom part 101 of the blank 300 from a punch surface of the punch top part 201*b* by an inner pad stroke (specifically, a length of the first pad 203 protruded from the punch top part 201*b*) Ip.

Meanwhile, the second pad 204 is applied force in the direction of the blank 300 by the pressure device, and sandwiches and binds the part to be formed to the groove bottom part 101 of the blank 300 with the first pad 203.

The blank 300 at this time is approximately flat when seen from a cross section in a width direction as illustrated in FIG. 3A, but, it is deformed so that one part of an end part in the longitudinal direction rises, as illustrated in FIG. 4A. This is because, to the punch 201, the outward flange forming surface 201*a* for forming the outward flange 106 is provided up to a position higher than that of the punch top part 201*b*. Note that it is not improbable that no deformation occurs depending on the inner pad stroke Ip.

The region 300*a*, in the blank 300, supported by the first pad 203 corresponds to a region at a center portion in the width direction of the part to be foamed to the groove bottom part 101 and along an entire length in the longitudinal direction, in examples of FIG. 3A and FIG. 4A. Specifically, it is desirable that end parts in the width direction of the first pad 203 are set on the inside of R end of ridge lines of the pad top part 201*b* of the pad 201, since a stretch deformation of stretch flange end being a main cause of fracture is dispersed, and a shrinkage deformation in the vicinity of a root of the flange being a main cause of wrinkling is reduced. Further, it is also possible that the first pad 203 does not exist on the region along the entire length in the longitudinal direction, and the first pad 203 is only required to separate a region positioned at least at the end portion in the longitudinal direction, of the part to be formed to the groove bottom part 101, from the punch top part 201*b*.

Figure 3B:
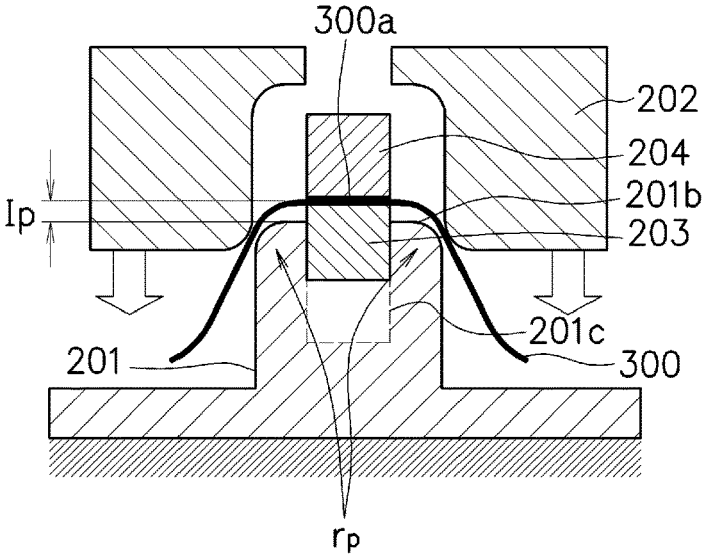
FIG. 3B is an explanatory view schematically illustrating a state of the press forming step, and a view illustrating a state in the middle of the press forming.
Figure 3C:
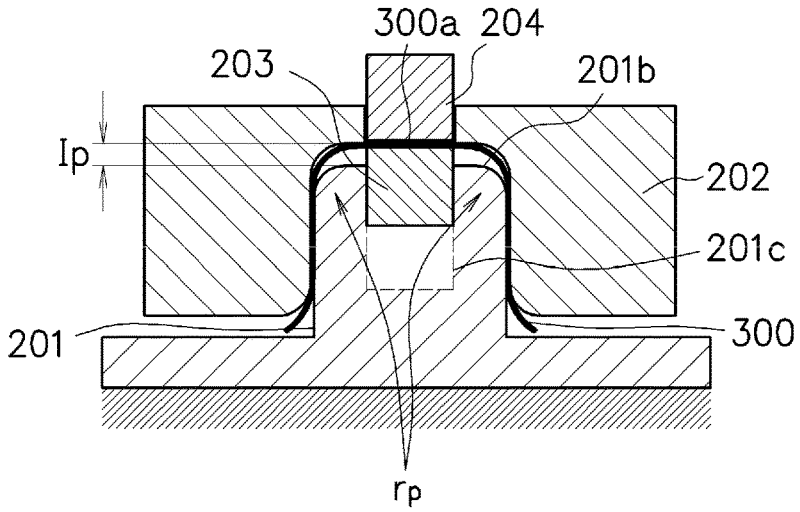
FIG. 3C is an explanatory view schematically illustrating a state of the press forming step, and a view illustrating a state in the middle of the press forming.
Figure 4B:
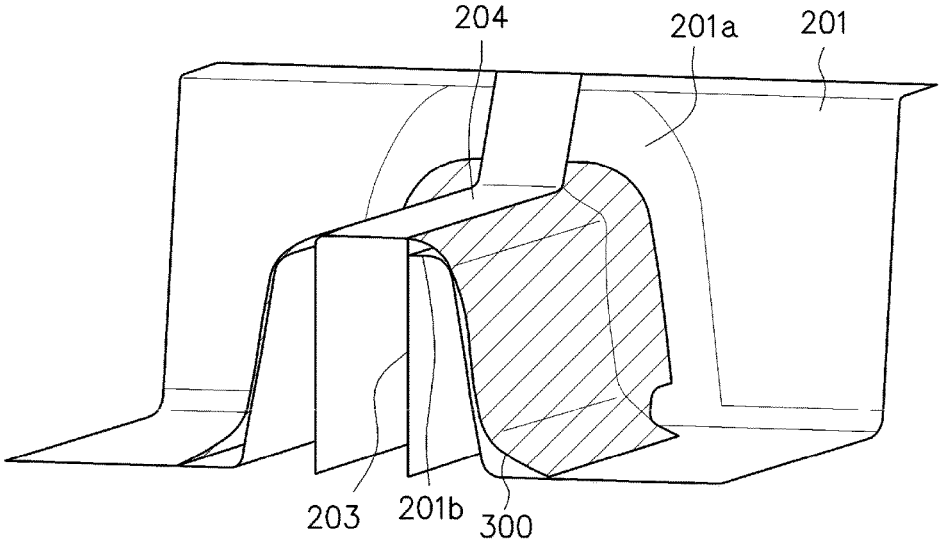
FIG. 4B is a view illustrating a state in the middle of the press forming through the press forming step.

FIG. 3B and FIG. 3C illustrate states in the middle of the press forming. Further, FIG. 4B illustrates a state in the middle of the press forming, in a similar manner to FIG. 3B and FIG. 3C, and illustrates shapes of the respective parts and the like more concretely. Note that in FIG. 4B, the die 202 is omitted in consideration of an easiness of viewing.

Note that as described above, there is a case in which the blank 300 is already deformed as illustrated in FIG. 4A, so that the start of the press forming mentioned here indicates a start of forming of parts to be formed to the ridge line parts 102 of the blank 300 as illustrated in FIG. 3B. When the press forming is started, forming of a part to be formed to the outward flange 106, particularly parts to be formed to the parts 106*a* of the outward flange 106 is substantially started, in accordance with the forming of the parts to be formed to the ridge line parts 102.

As illustrated in FIG. 3C, when a height of a surface or line that forms the groove bottom part 101 in the die 202 becomes almost the same as that of a surface, which abuts against the groove bottom part 101, of the second pad 204, the first pad 203 starts lowering, resulting in that the inner pad stroke Ip starts decreasing. It is easily realizable in terms of apparatus structure to design such that the second pad 204 is lowered in conjunction with the die 202, and the first pad 203 starts lowering by being pushed by the second pad 204. Note that it is also possible that the inner pad stroke Ip starts decreasing gradually from a time same as the start of the press forming.

Figure 3D:
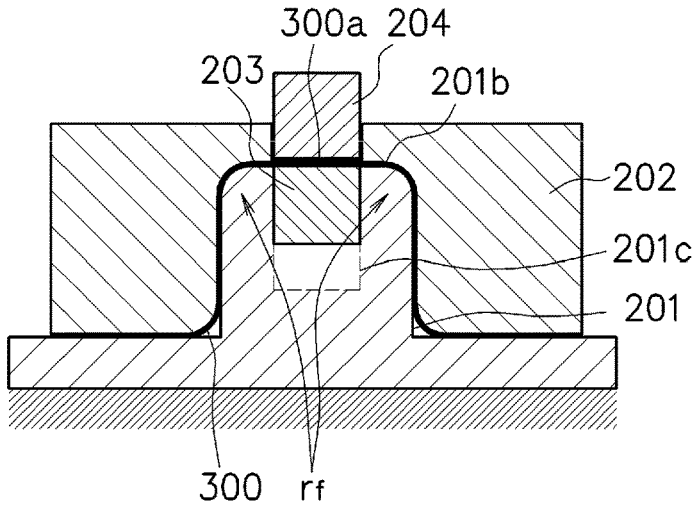
FIG. 3D is an explanatory view schematically illustrating a state of the press forming step, and a view illustrating a state when the press forming is completed.
Figure 4C:
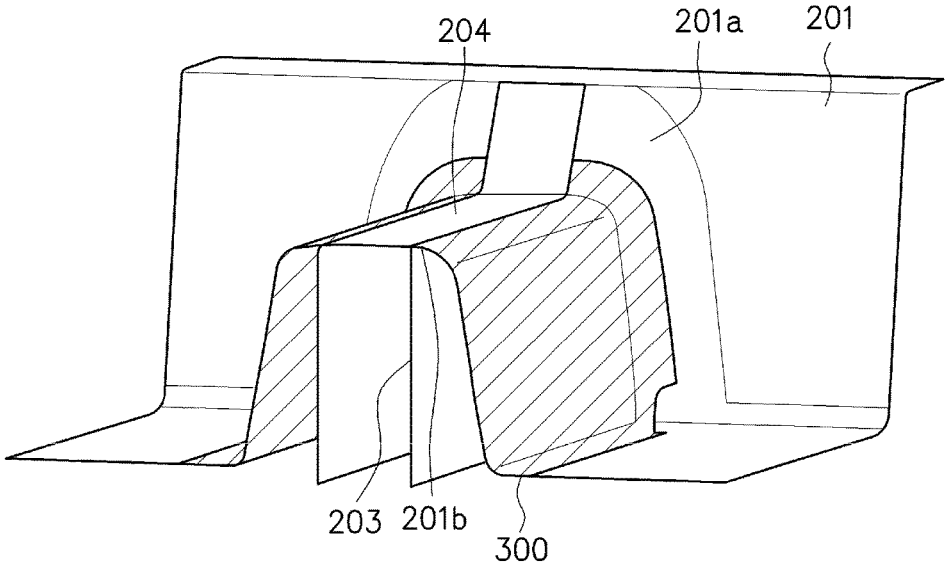
FIG. 4C is a view illustrating a state when the press forming through the press forming step is completed.

FIG. 3D illustrates a state when the press forming is completed, namely, a state at a bottom dead center of the forming. Further, FIG. 4C illustrates a state when the press forming is completed, in a similar manner to FIG. 3D, and illustrates shapes of the respective parts and the like more concretely. Note that in FIG. 4C, the die 202 is omitted in consideration of an easiness of viewing.

When the press forming is completed, the first pad 203 is housed in the pad housing hole 201*c*, and the inner pad stroke Ip becomes zero. Specifically, the first pad 203 becomes flush with the punch top part 201*b*.

Figure 5A:
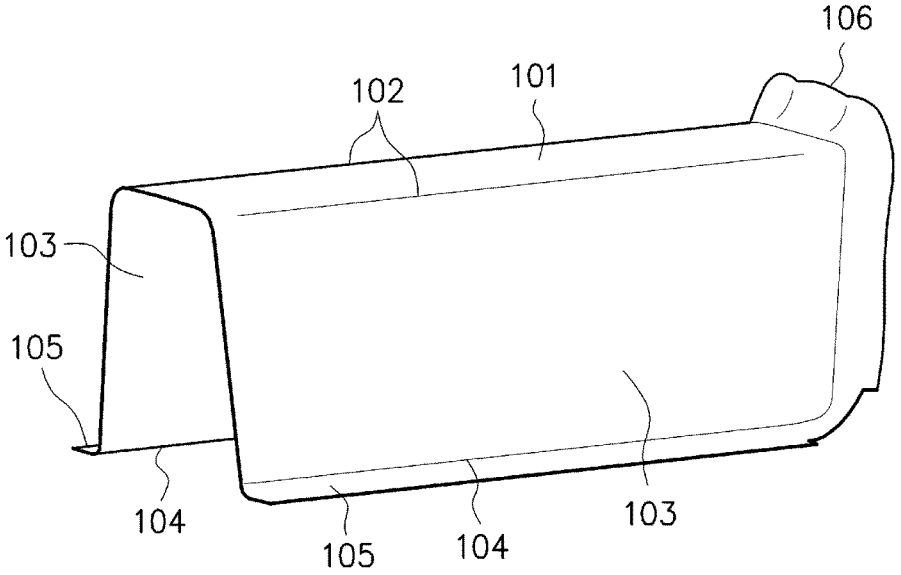
FIG. 5A is a perspective view illustrating a part of a press-formed product obtained through the press forming step.

Here, when the press forming in the press forming step is completed, the forming of the groove bottom part 101, the forming of the ridge line parts 102, the forming of the vertical wall parts 103, the forming of the curved parts 104, the forming of the flanges 105, and the forming of the outward flange 106 are completed. However, the outward flange 106 is in a state of extending in a diagonally outer direction in a longitudinal direction of a press-formed product, as illustrated in FIG. 5A. Specifically, a rising angle of a part, formed from the groove bottom part 101 along the two ridge line parts 102, 102, of the outward flange 106 is smaller than the rising angle $\alpha$ of the outward flange 106 described in FIG. 1B. For example, although the rising angle $\alpha$ of the outward flange 106 of the press-formed member 100 as a product is 80 degrees, the rising angle of the outward flange 106 in the press-formed product obtained through the press forming step is 60 degrees. Further, a part, along the vertical wall part 103, of the outward flange 106 is not perpendicular to the vertical wall part 103, but rises gently at a predetermined angle.

If the above-described steps are stated in other words, by creating a state where the region 300*a* of the blank 300 is pushed up by the first pad 203, there is a state where, in the middle of the press forming, a radius of curvature $r_p$ of each of the parts to be formed to the ridge line parts 102 of the blank 300 once becomes larger than a radius of curvature $r_f$ of each of the ridge line parts 102 at the point of time of completion of the press forming (refer to FIG. 3B and FIG. 3C). At this time, more specifically, there is a state where the region in which the curvature is formed is wider than the region of each of the ridge line parts 102 at the point of time of completion of the press forming, and is widened by being extended toward the groove bottom part 101 side.

Further, in the process of the press forming thereafter, the region 300*a* of the blank 300 is made to approach the punch top part 201*b*, so that the radius of curvature $r_p$ becomes small to be close to the radius of curvature $r_f$. Note that, although there locally exists a portion, in the part to be formed to the ridge line part 102, whose radius of curvature is smaller than the radius of curvature $r_f$ due to the reason that the portion is brought into contact with a shoulder of the first pad 203 and the like, the radius of curvature $r_p$ is not a value regarding such a micro-shape, and is a value regarding an entire shape of the part to be formed to the ridge line part 102.

Further, at the bottom dead center of the forming being the time of completion of the press forming, the first pad 203 is completely housed in the pad housing hole 201*c*, resulting in that the radius of curvature $r_f$ coincides with the radius of curvature $r_p$.

As described above, when the forming of the ridge line parts 102, and in accordance with that, the forming of the parts 106*a* of the outward flange 106 are conducted, the parts are not formed rapidly into their final shapes, but formed relatively moderately from the start to the middle of the press forming by using the first pad 203, to thereby reduce or prevent the occurrence of stretch flange fracture at the outer peripheral edge portions of the parts 106*a* of the outward flange 106, and the generation of wrinkling at the portion of the ridge line part 102 in the vicinity of the outward flange 106 or the portion in the vicinity of the root in the outward flange 106 (refer to portions 102*a* in FIG. 1A).

Further, it is desirable to sandwich and bind the region 300*a* of the blank 300 using the first pad 203 and the second pad 204 from the start to the completion of the press forming, for preventing the reduction in formability due to the positional displacement of the blank 300, and for suppressing the reduction in dimensional accuracy of the formed product.

The press-formed product obtained through the press forming step is sometimes a press-formed member as it is as a product, and in some cases, the process proceeds to the post-press forming step by using the press-formed product as an intermediate formed product, as will be described later.

(3) Post-Press Forming Step

As illustrated in FIG. 5A, in the press-formed product obtained through the above-described press forming step, the outward flange 106 is in a state of extending in the diagonally outer direction in the longitudinal direction of the press-formed product.

Figure 5B:
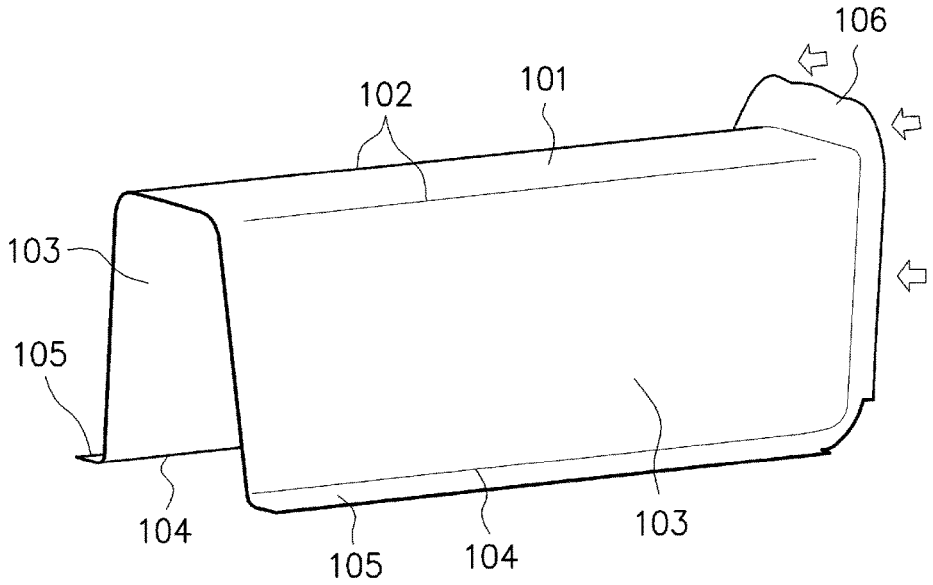
FIG. 5B is a perspective view illustrating a part of a press-formed product obtained through a post-press forming step.

In the post-press forming step, the outward flange 106 of the press-formed product obtained through the press forming step is further raised, as illustrated in FIG. 5B (refer to arrow marks in FIG. 5B). Specifically, the part, along the groove bottom part 101, of the outward flange 106 is raised to set a rising angle of the part to be a. Further, the part, along the vertical wall part 103, of the outward flange 106 is raised to set the part to be approximately perpendicular to the vertical wall part 103, for example.

As a method of raising the outward flange 106, a method of using a cam structure, or a bending method which does not use the cam structure, for example, can be employed.

Specifically, it can also be said that the post-press forming step is a step in which the press-formed product obtained through the press forming step is set as the intermediate formed product, and by raising the outward flange 106 of the product, the press-formed member 100 as a product is obtained. Although there is certainly a case where the press-formed product obtained through the press forming step can be set as it is to the press-formed member as a product, in a case where a degree of dimensional accuracy and a degree of rising of the outward flange in the press-formed member are moderate and the like, and in this case, the post-press forming step may be omitted.

Figure 6A:
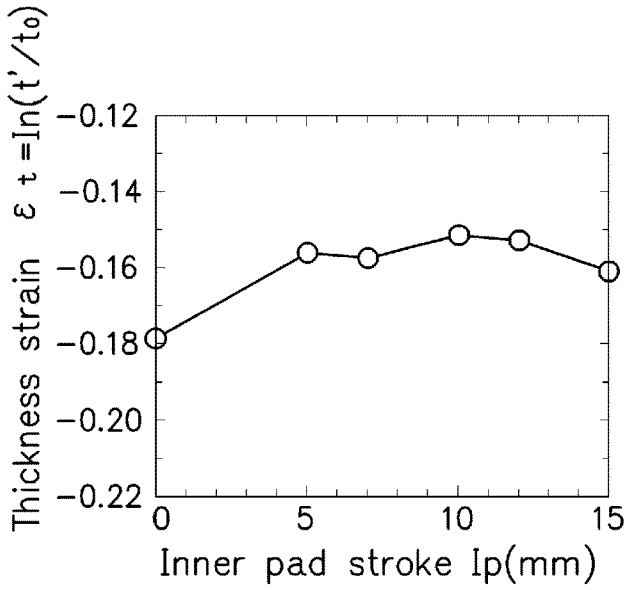
FIG. 6A is a characteristic chart illustrating a result of numerical analysis of a sheet thickness strain at an end portion of a part along a ridge line part of an outward flange with respect to an inner pad stroke Ip.
Figure 6B:
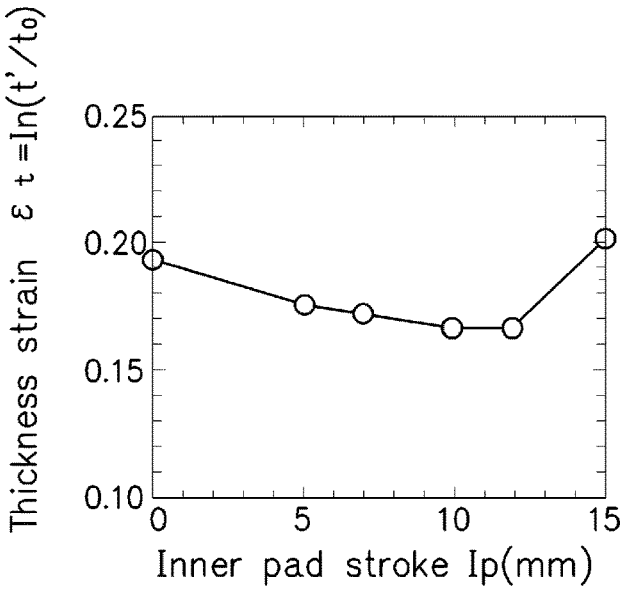
FIG. 6B is a characteristic chart illustrating a result of numerical analysis of a sheet thickness strain in the vicinity of a root portion of the part along the ridge line part of the outward flange (rising portion of the ridge line part) with respect to the inner pad stroke Ip.

FIG. 6A and FIG. 6B illustrate results of numerical analysis performed by modelling a state where a 980 MPa-class dual phase steel sheet having a sheet thickness of 1.4 mm is press-formed in the above-described press forming step.

In the targeted press-formed product, it was set that a height (from a lower surface of the flange 105 to an upper surface of the groove bottom part 101) is 100 mm, a curvature of the ridge line part 102 is 12 mm, a cross-sectional wall angle θ is 80 degrees, the rising angle α is 80 degrees, a width of flat portion of the groove bottom part 101 is 60 mm, a flange width of the outward flange 106 (except for the vicinity of the parts 106*a*) is 15 mm, and a curvature of a rising portion of the outward flange 106 is 3 mm. Further, although the press forming tool has a shape which is nearly a shape corresponding to the press-formed member, in this case, the forming was conducted by the press forming step and the post-press forming step. In the press forming step, a rising angle of the outward flange 106 of the forming tool of the parts corresponding to the groove bottom part 101, the ridge line parts 102 and the vertical wall parts 103 was set to 60 degrees, and an inner pad width in the press forming step was set to 44 mm.

FIG. 6A illustrates a result of numerical analysis of a sheet thickness strain at an outer peripheral edge portion of the part 106*a* of the outward flange 106 with respect to the inner pad stroke Ip. Further, FIG. 6B illustrates a result of numerical analysis of a sheet thickness strain in the vicinity 102*a* of a root portion of the part 106*a* of the outward flange 106 (rising portion of the ridge line part 102) with respect to the inner pad stroke Ip. $t'/t_0$ indicates a ratio of a sheet thickness after the forming with respect to a sheet thickness before the forming.

Note that a state where the inner pad stroke Ip is 0 mm, is equivalent to a state where the first pad 203 does not exist in a press forming tool.

When the inner pad stroke Ip is 0 mm, since the sheet thickness strain at the outer peripheral edge portion of the part 106*a* of the outward flange 106 reaches up to about −0.18, as illustrated in FIG. 6A, it is concerned that the sheet thickness is reduced to cause the occurrence of stretch flange fracture. Further, since the sheet thickness strain at the root portion of the part 106*a* of the outward flange 106 (the rising portion of the ridge line part 102) reaches up to about 0.19, as illustrated in FIG. 6B, the generation of wrinkling is concerned.

On the contrary, in the press forming to which the present invention is applied, it can be understood that by providing the inner pad stroke Ip, it is possible to suppress the reduction in sheet thickness at the outer peripheral edge portion of the part 106*a* of the outward flange 106, and the increase in thickness in the vicinity 102*a* of the root portion of the part 106*a* of the outward flange 106 (the rising portion of the ridge line part 102). Accordingly, it becomes possible to effectively realize the suppression of the stretch flange fracture and the suppression of the generation of wrinkling.

Figure 7:
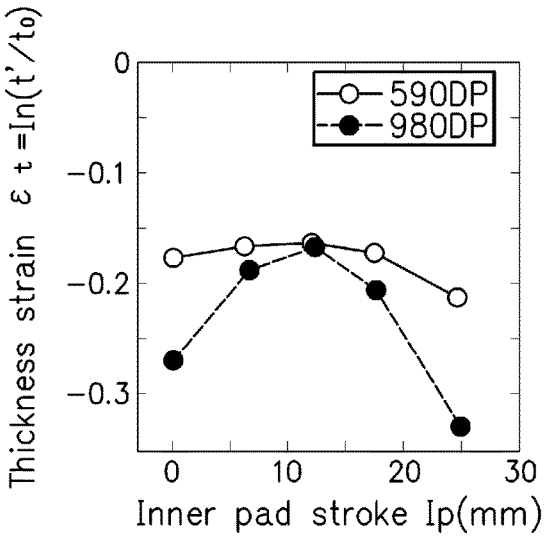
FIG. 7 is a characteristic chart illustrating a measured result of a sheet thickness strain at an outer peripheral edge portion of the outward flange with respect to the inner pad stroke Ip.
Figure 8A:
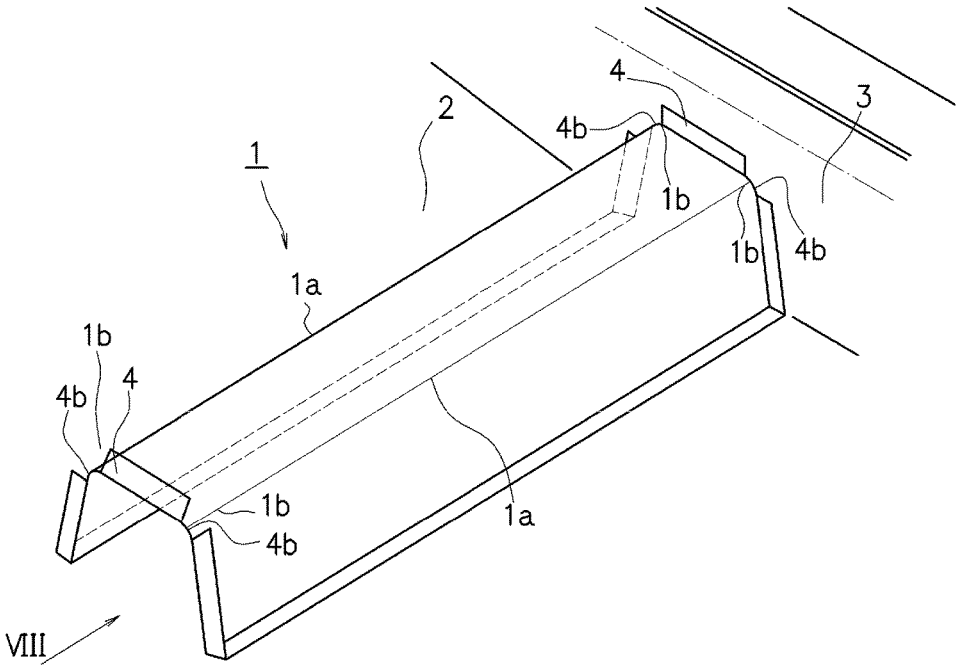
FIG. 8A is a perspective view of a conventional floor cross member.
Figure 8B:
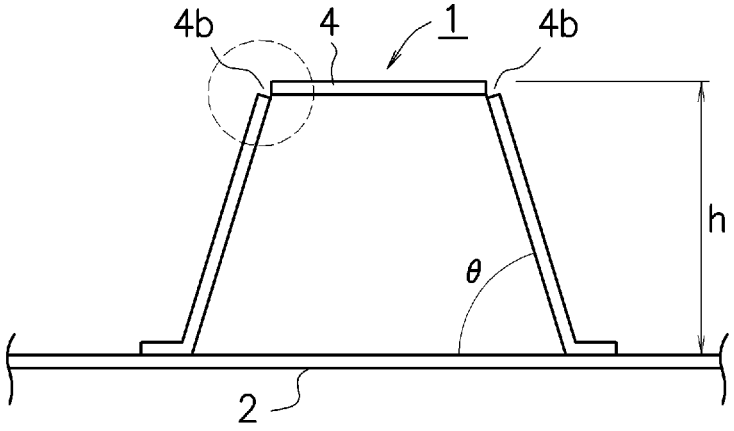
FIG. 8B is a VIII arrow view in FIG. 8A.
Figure 8C:
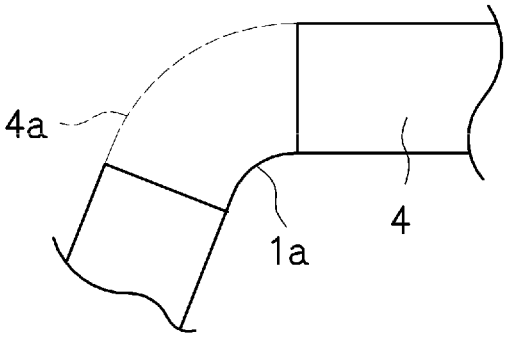
FIG. 8C is an explanatory view illustrating a portion surrounded by a circular dotted line in FIG. 8B, in an enlarged manner.
Figure 9A:
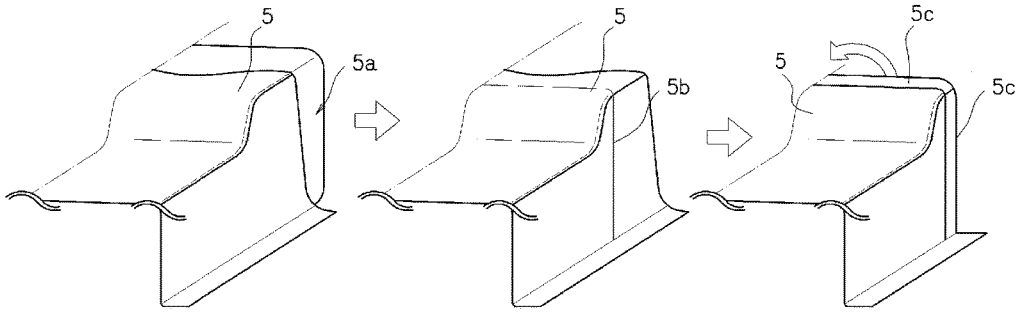
FIG. 9A is an explanatory view illustrating an outline of a conventional press forming method of a floor cross member, and a view illustrating a case where the press forming is performed by drawing.
Figure 9B:
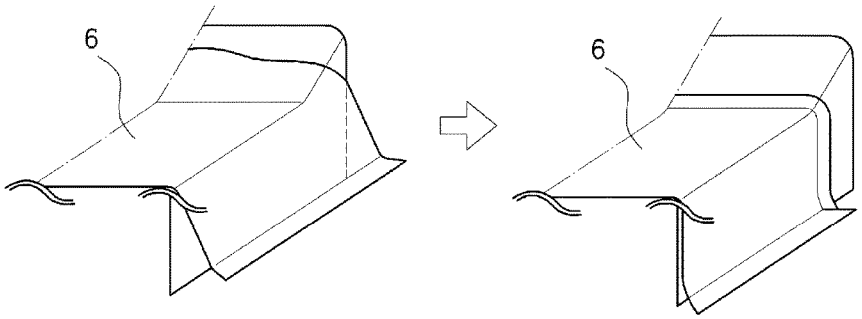
FIG. 9B is an explanatory view illustrating an outline of a conventional press forming method of a floor cross member, and a view illustrating a case where the press forming is performed by bend forming using an expanded blank.

FIG. 7 illustrates results of experiment obtained by actually performing press forming on a dual phase steel sheet of 590 MPa class (having a sheet thickness of 1.39 mm), and a dual phase steel sheet of 980 MPa class (having a sheet thickness of 1.4 mm), through the above-described press forming step. Note that the targeted press-formed product is the same as that of the case of FIG. 6A and FIG. 6B.

FIG. 7 illustrates a measured result of a sheet thickness strain at the outer peripheral edge portion of the outward flange 106 with respect to the inner pad stroke Ip. The sheet thickness strain is specifically a sheet thickness strain at the thinnest portion of the outer peripheral edge portion of the outward flange 106.

As illustrated in FIG. 7, even in a case where the dual phase steel sheet of 980 MPa class, which is further difficult to be formed, is employed, by setting the inner pad stroke Ip within a range of 6 mm to 18 mm, it becomes possible to effectively realize the suppression of the stretch flange fracture.

As described above, it is possible to improve the formability of the continuous outward flange 106 including the parts 106*a*, without providing cutouts which are deep enough to reach the ridge line parts 102 to the parts 106*a* of the outward flange 106 and without generating lowering of material yield.

As stated above, the present invention is described with various embodiments, but, the present invention is not limited only to these embodiments, and modifications and so on can be made within a scope of the present invention.

The above-described embodiment is described by citing a case, as an example, in which both of the press forming step and the post-press forming step are conducted by the press forming through the bend forming which uses no blank holder, but, the present invention is not limited to this press forming, and can also be applied to press forming by drawing which uses the blank holder.

Further, although the above-described embodiment describes that the punch 201 is positioned on the lower side, and the die 202 is positioned on the upper side, the relationship of the upper and lower positions may also be opposite, for example.

Further, in the present invention, the press forming step or the post-press forming step is not limited to the cold forming, and may also be hot forming (so-called hot stamping). However, since the hot forming can originally realize good stretch flanging, it is further effective to apply the present invention particularly to the cold forming.

INDUSTRIAL APPLICABILITY

The present invention can be utilized for manufacturing, not only a structural member of automobile but also a press-formed member, from a blank of high-tensile strength steel sheet of 390 MPa or more, with a shape of cross section having at least a groove bottom part, ridge line parts continued to end portions in a width direction of the groove bottom part, and vertical wall parts continued to the ridge line parts, and in which an outward flange including parts along the ridge line parts is formed at an end part in a longitudinal direction.

The invention claimed is:

1. A manufacturing method of a press-formed member, comprising a press forming step of obtaining, from a blank of high-tensile strength steel sheet of 390MPa or more, a press-formed product with a shape of cross section having at least a groove bottom part, a ridge line part continued to an end portion in a width direction of the groove bottom part, and a vertical wall part continued to the ridge line part, and in which an outward flange including a part along the ridge line part is formed at an end part in a longitudinal direction, by using a press forming apparatus including a punch and a die, wherein the press forming step includes:

creating a state where a radius of curvature $r_p$ of a part to be formed to the ridge line part of the blank once becomes larger than a radius of curvature $r_f$ of the ridge line part at a point of time of completion of the press forming, in the middle of the press forming;

making the radius of curvature $r_p$ approach the radius of curvature $r_f$ in a process of the press forming thereafter; and completing, when the press forming is completed, the forming of the groove bottom part, the forming of the ridge line part, the forming of the vertical wall part, and the forming of the outward flange.

2. The manufacturing method of the press-formed member according to claim 1, wherein in the state where the radius of curvature $r_p$ becomes larger than the radius of curvature $r_f$, a region in which the curvature is formed is in a state of being wider than a region of the ridge line part at the point of time of completion of the press forming, and is in a state of being widened by being extended toward the groove bottom part side.

3. A manufacturing method of a press-formed member, comprising a press forming step of obtaining, from a blank of high-tensile strength steel sheet of 390 MPa or more, a press-formed product with a shape of cross section having at least a groove bottom part, a ridge line part continued to an end portion in a width direction of the groove bottom part, and a vertical wall part continued to the ridge line part, and in which an outward flange including a part along the ridge line part is formed at an end part in a longitudinal direction, by using a press forming apparatus including a punch and a die, wherein the press forming step includes:

a first step of starting forming of a part to be formed to the ridge line part and forming of the outward flange, by creating a state where a region positioned at least at an end portion in a longitudinal direction of a part to be formed to the groove bottom part of the blank is separated from a punch top part, in the punch, which forms the groove bottom part;

a second step of making, at the time of starting the forming of the part to be formed to the ridge line part or thereafter, the region approach the punch top part; and completing, when the press forming is completed, the forming of the groove bottom part, the forming of the ridge line part, the forming of the vertical wall part, and the forming of the outward flange.

4. The manufacturing method of the press-formed member according to claim 3, wherein:

in the first step, the region is set to be in the state of being separated from the punch top part by creating a state where a first pad provided to be able to freely protrude from or withdraw into the punch top part, is protruded from the punch top part; and in the second step, the first pad is lowered to make the region approach the punch top part.

5. The manufacturing method of the press-formed member according to claim 4, wherein the first pad and a second pad provided on a side opposite to that of the first pad with the blank provided therebetween are used to sandwich and bind the blank.

6. The manufacturing method of the press-formed member according to claim 5, further comprising a post-press forming step with respect to the press-formed product, wherein in the post-press forming step, the outward flange of the press-formed product is further raised.

7. The manufacturing method of the press-formed member according to claim 4, further comprising a post-press forming step with respect to the press-formed product, wherein in the post-press forming step, the outward flange of the press-formed product is further raised.

8. The manufacturing method of the press-formed member according to claim 3, further comprising a post-press forming step with respect to the press-formed product, wherein in the post-press forming step, the outward flange of the press-formed product is further raised.

* * * * *